US005324018A

United States Patent [19]

Miura et al.

[11] Patent Number: 5,324,018

[45] Date of Patent: Jun. 28, 1994

[54] PAPER TRANSPORT SYSTEM

[75] Inventors: Tsutomu Miura, Kawasaki; Hideyuki Sakaizawa, Yokohama; Shigeomi Koshimizu; Hidehiro Nishiguchi, both of Kawasaki, all of Japan

[73] Assignee: Eastman Kodak Company, Rochester, N.Y.

[21] Appl. No.: 11,622

[22] Filed: Feb. 1, 1993

[30] Foreign Application Priority Data

Mar. 31, 1992 [JP] Japan ..... 4-077878

[51] Int. Cl.[5] ..... B65H 3/52

[52] U.S. Cl. ..... 271/122; 271/109; 271/126

[58] Field of Search ..... 271/18, 109, 121, 122, 271/126, 127, 145, 155, 162, 147

[56] References Cited

U.S. PATENT DOCUMENTS 3,655,183 4/1972 Wagner ..... 271/155

3,870,294 3/1975 Donner ..... 271/122

*Primary Examiner*—H. Grant Skaggs

*Attorney, Agent, or Firm*—Raymond L. Owens

[57] ABSTRACT

A paper transport apparatus has an inclinable feed-in tray. Documents are drawn from the feed-in tray with a feed roller operating in conjunction with a retard roller. The rollers and the feed-in tray are supported on a pivotable frame. Pivoting of the frame permits the feed-in tray to be inclined to a desired angle to facilitate feeding of documents that do not readily slide while resulting in the documents being fed to the rollers at a constant entry angle irrespective of the angle of inclination of the feed-in tray.

7 Claims, 2 Drawing Sheets

PAPER TRANSPORT SYSTEM

FIELD OF THE INVENTION

The present invention relates to a paper transport system, and, more particularly, to a paper transport system of a type used in scanning or copying machines

BACKGROUND OF THE INVENTION

Copying machines, facsimile machines, document scanners and other such systems are provided with a paper transport system for transporting documents to a scanning section. Typically, these paper transport systems employ a tray to support input documents. The input documents vary in type, size and quality. Certain types of these documents do not slide readily. For example, papers that have been subjected to much handling, special-delivery postal slips and other such documents do not slide across each other readily and are thus difficult to feed.

Conventional feed-in trays are adapted to be tilted or positioned at various angles. When a conventional feed in tray is set in a horizontal position, the documents which do not readily slide cannot be fed smoothly. In order to feed these documents smoothly, it is necessary to tilt the feed-in tray substantially. However, when the feed-in tray is set with a large entry angle, the documents reach the next section of the document path with a correspondingly large entry angle. If the entry angle is too large a high incidence of document jamming occurs.

Thus a user of the prior art document transport system is faced with a dilemma. If the entry angle is set low, there is little jamming, but certain documents will not feed smoothly from the tray. If the entry angle is set high, then documents slide readily from the tray, but there is a high incidence of document jamming. The reason for document jamming in the prior art transport system can be better understood by reference to FIG. 1.

Referring now to FIG. 1, there is shown a cross sectional view of a prior art paper transport apparatus 10. The transport apparatus 10 comprises a feed-in tray 12, a feed roller 14, a retard roller 16, a tray latch 18, and a document guide 20. The feed-in tray 12 can be set to different discrete angles up to a position shown in dashed lines and designated 12*a*. This change of angle of the feed-in tray 12 increases the angle of entry of the tray 12 relative to the document guide 20. It can be seen that documents (not shown) will slide readily on the feed-in tray 12*a*, but there is a substantial change in direction of the documents along the document guide 20 in the region near the feed roller 14. This change in direction contributes to document jamming.

It is desirable therefore to provide a document transport apparatus which permits a user to feed documents which do not readily slide into a machine without encountering document jamming.

SUMMARY OF THE INVENTION

The present invention is directed to a paper transport apparatus which is adaptable to transporting paper that does not readily slide. An inclinable feed-in tray is attached to a pivotable frame. The frame is also attached to feed roller and a retard roller. Irrespective of the angle of inclination of the feed-in tray, an angle of entry of a document to the rollers remains constant.

Viewed from one aspect, the present invention is directed to a paper transport apparatus. The apparatus comprises an inclinable feed-in tray in which documents are stacked, a feed roller for drawing documents from the feed in tray, and a frame that pivotally supports the feed roller and feed-in tray such the documents are transported from the feed-in tray at an angle of entry that remains constant relative to the feed roller irrespective of the inclination of the feed-in tray.

Viewed from another aspect, the present invention is directed to a paper transport apparatus that comprises a feed in tray in which documents are stacked, a feed roller positioned near the feed-in tray for drawing in a topmost document from the feed-in tray, a retard roller positioned near the feed-in tray in opposition to the feed roller, the retard roller being driven to rotate counterclockwise to urge documents other than the topmost document back towards the feed-in tray, and a frame that is coupled with the feed-in tray and in which the feed roller and retard roller are rotatably supported. The frame is adapted to pivot so that the feed-in tray is inclinable to a desired angle. The frame is also adapted to maintain a spatial relationship between the feed-in tray, the feed roller and the retard roller such that documents are transported from the feed-in tray at an angle of entry that remains constant relative to the feed roller and retard roller irrespective of the angle at which the feed-in tray is inclined.

The invention will be better understood from the following detailed description taken in consideration with the accompanying drawings and claims.

The drawings are not necessarily to scale.

DETAILED DESCRIPTION

Figure 1:
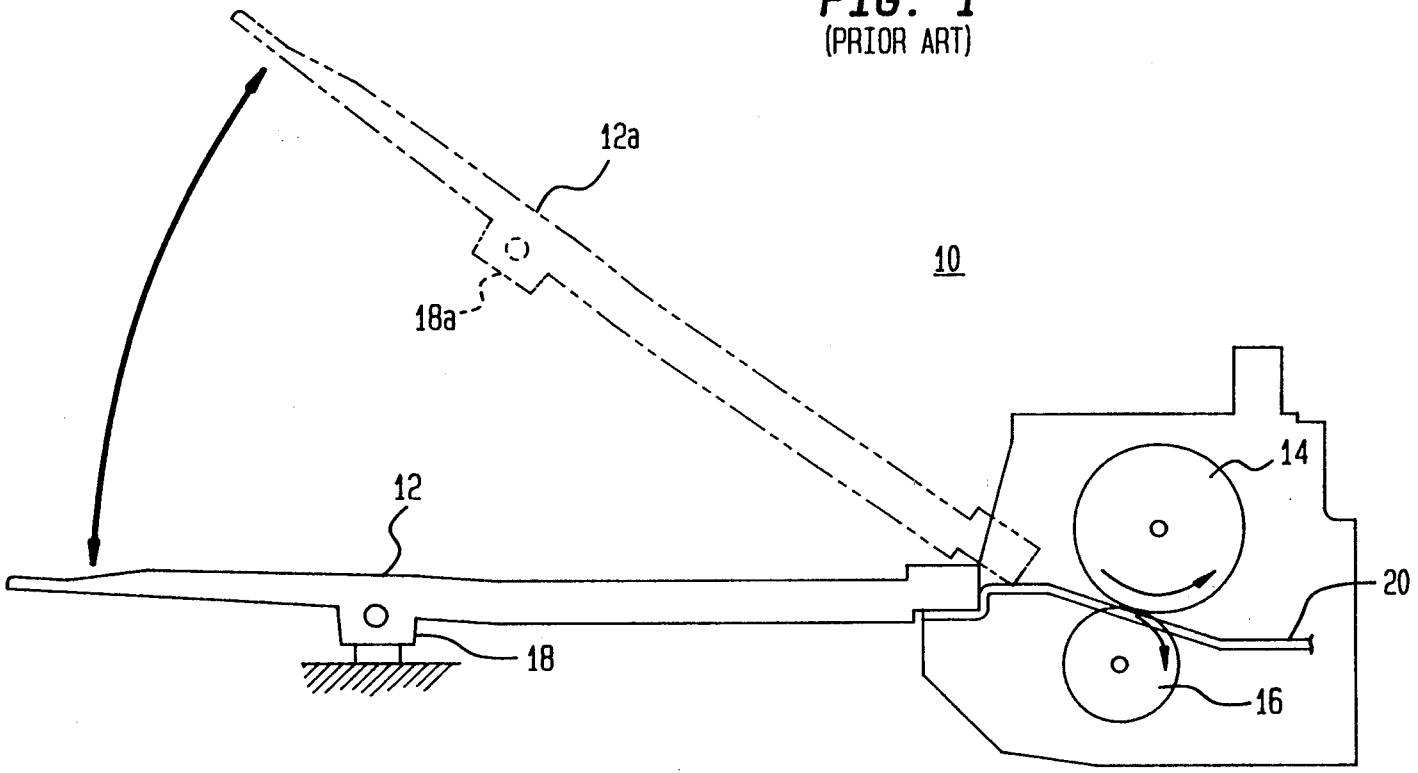
FIG. 1 (PRIOR ART)
FIG. 1 is cross-sectional view of a paper transport system in accordance with the prior art.
Figure 2:
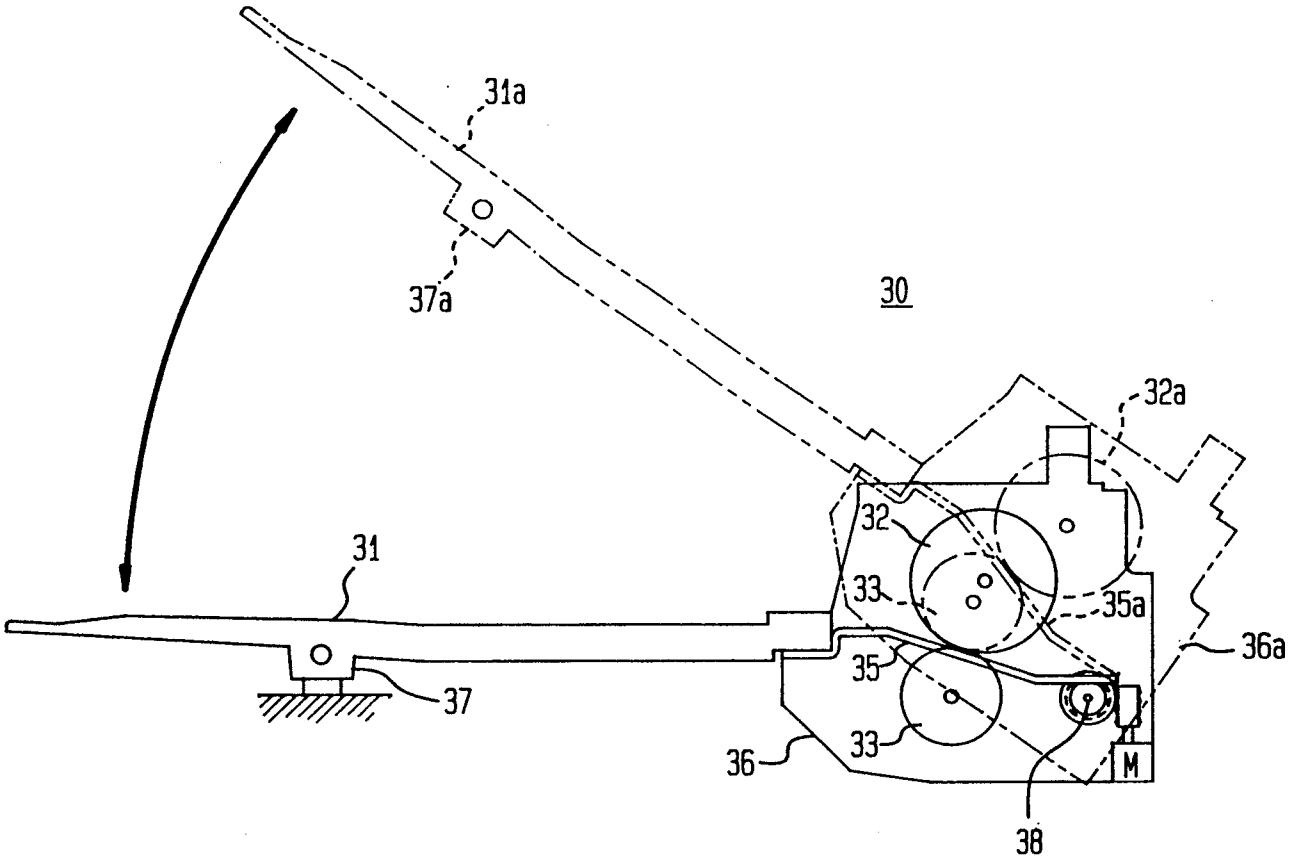
FIG. 2 is a cross-sectional view of a paper transport apparatus in accordance with the present invention.

Referring now to FIG. 2, there is shown a cross-sectional view of a paper transport apparatus 30 in accordance with the present invention. The paper transport apparatus 30 comprises a feed in tray 31 in which documents (not shown) to be scanned are stacked, a feed roller 32, a retard roller 33, a document guide 35, a frame 36, a tray latch 37, and a conventional worm gear motor pivot drive 38. The feed roller 32 and the retard roller 33 are arranged in mutual opposition near the feed-in tray 31, with the feed roller 32 adapted to draw in the topmost document with clockwise rotation. Counterclockwise rotation of the retard roller 13 serves to urge the documents below the topmost one back towards the feed-in tray 31, and the document guide 35. The frame 36 rotatably supports the feed roller 32 and the retard roller 33. The frame 36 is adapted to be pivoted by the motor pivot drive 38. Unlike the prior art paper transport apparatus 10 of FIG. 1, the feed in tray 31 can be steplessly inclined to many different angles.

The feed-in tray 31, the feed roller 32, the retard roller 33, the document guide 35, and the frame 36 are shown in a pivoted position by a dashed line representation of the elements designated 31*a*, 32*a*, 33*a*, 35*a*, and 36*a*, respectively. It can be seen that in this pivoted position the feed-in tray 31*a* is inclined substantially so that documents will readily slide thereon. However, the feed-in tray 31*a* is oriented to the document guide 35*a* in exactly the same way as when the feed-in tray 31 is in a horizontal position. Thus documents can be fed by the transport apparatus 30 without encountering an abrupt change in direction in the region of the feed roller 32 even when the feed-in tray 31 is tilted at a high angle. Indeed, with the paper transport apparatus 30, the entry angle of documents remains constant irrespective of the angle at which the feed-in tray 31 is positioned. Thus, documents drawn in from the feed-in tray 31 are transported smoothly without becoming jammed.

It is to be appreciated and understood that the specific embodiments of the invention are merely illustrative of the general principles of the invention. Various modifications may be made by those skilled in the art which are consistent with the principles set forth. For example, although in the above description the frame 36 is pivoted by the motor pivot drive 38, it is possible to operate the apparatus 30 with a slotted plate (not shown) alongside the feed-in tray 31 into which the latch 37 can be manually locked at various positions to achieve tilting of the tray 31. This would allow for an elimination of the motor pivot drive 38 and provide for a less costly transport apparatus 30.

What is claimed is:

1. A paper transport apparatus comprising:

an inclinable feed-in tray adapted to have documents therein;

a feed roller adapted to draw in a document from the feed-in tray;

means for urging documents other than the drawn-in document back to the feed-in tray; and means for pivotally supporting the feed roller and feed-in tray such that the documents are transported from the feed-in tray at an angle of entry that remains constant relative to the feed roller irrespective of the inclination of the feed-in tray.

2. The paper transport apparatus of claim 1 in which the pivotally supporting means is a frame which is adapted to be pivoted with a worm gear drive.

3. The paper transport apparatus of claim 1 wherein the angle of inclination of the feed-in tray is variable steplessly.

4. A paper transport apparatus comprising:

a feed-in tray which is adapted to have documents stacked therein;

a feed roller positioned near the feed-in tray and being adapted to rotate in a first direction to draw in a topmost document from the feed-in tray;

a retard roller positioned near the feed-in tray in opposition to the feed roller, said retard roller being adapted to be driven to rotate in a second direction opposite to said first direction so as to urge documents other than the topmost document back towards the feed-in tray;

a frame that is coupled with the feed-in tray and in which the feed roller and retard roller are rotatably supported;

the frame being adapted to pivot so that the feed-in tray is inclinable to a desired angle; and the frame being adapted to maintain a spatial relationship between the feed-in tray, the feed roller and the retard roller such that documents are transported from the feed-in tray at an angle of entry that remains constant relative to the feed roller and retard roller irrespective of the angle at which the feed-in tray is inclined.

5. The paper transport apparatus of claim 4 which further comprises a paper guide positioned between the feed-in tray and the feed roller, which paper guide is coupled to the frame so that its orientation relative to the feed-in tray and feed roller remains constant irrespective of the angle of inclination of the feed-in tray.

6. Paper transport apparatus for a scanning machine comprising:

a feed-in tray adapted to have stacked therein documents which are to be scanned;

a feed roller adapted to rotate in a first direction to draw in a topmost document stacked in the feed-in tray and being positioned near the feed-in tray;

a retard roller positioned near the feed-in tray in opposition to the feed roller, said retard roller being adapted to be driven to rotate in a second direction opposite to said first direction so as to urge documents other than the topmost document back towards the feed-in tray;

a frame that is coupled with the feed-in tray and in which the feed roller and retard roller are rotatably supported;

the frame being adapted to pivot so that the feed-in tray is inclinable to a desired angle; and the frame being adapted to maintain a spatial relationship between the feed-in tray, the feed roller and the retard roller such that documents are transported from the feed-in tray at an angle of entry that remains constant relative to the feed roller and retard roller irrespective of the angle at which the feed-in tray is inclined.

7. The paper transport apparatus of claim 6 further comprising a paper guide positioned between the feed-in tray and the feed roller, which paper guide is coupled to the frame so that its orientation relative to the feed-in tray and feed roller remains constant irrespective of the angle of inclination of the feed in tray.

* * * * *